United States Patent [19]

Gill

[11] 4,366,698

[45] Jan. 4, 1983

[54] ADJUSTABLE DIE ASSEMBLY

[76] Inventor: Gregg L. Gill, 1763 Underwood St., Cuyahoga Falls, Ohio 44221

[21] Appl. No.: 194,011

[22] Filed: Oct. 6, 1980

[51] Int. Cl.[3] ..... B21D 37/04

[52] U.S. Cl. ..... 72/389

[58] Field of Search ..... 72/389, 386, 380, 446, 72/447, 448

[56] References Cited

U.S. PATENT DOCUMENTS

| | | | |
|---|---|---|---|
| 784,725 | 3/1905 | Yates | 72/389 |
| 2,451,302 | 10/1948 | Peters | 72/446 |
| 2,748,829 | 6/1956 | Korenak | 72/389 |
| 4,106,323 | 8/1978 | Haenni | 72/389 |

*Primary Examiner*—Gene Crosby

*Attorney, Agent, or Firm*—Pollock, Vande Sande & Priddy

[57] ABSTRACT

The present invention relates to adjustable positionable die members of the type employed in a press brake or the like, wherein a plurality of grooves are formed in a frame supported on the press brake bed with support blocks slidably received in the grooves. Connecting bolts attach the die members to the support blocks and positioning pins extend through the die members into openings formed in the frame to align the die members relative to one another.

13 Claims, 8 Drawing Figures

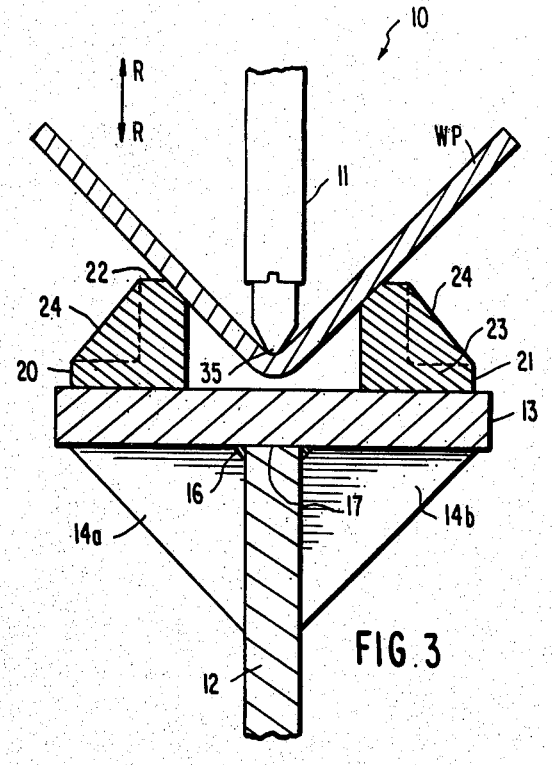
FIG. 3
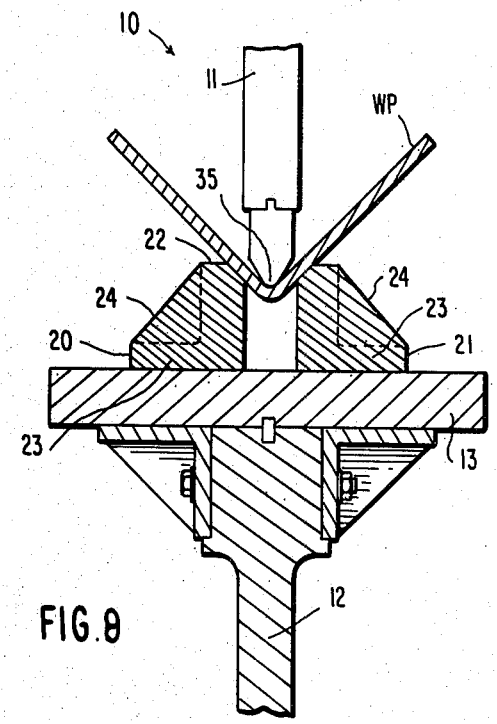
FIG. 8
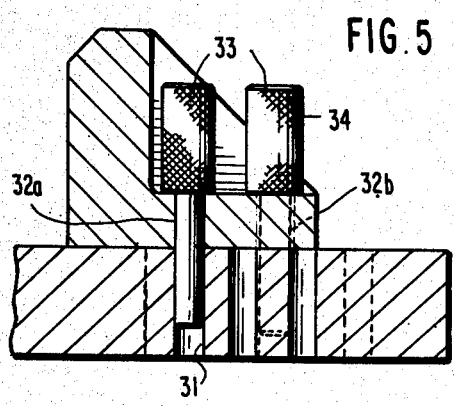
FIG. 5
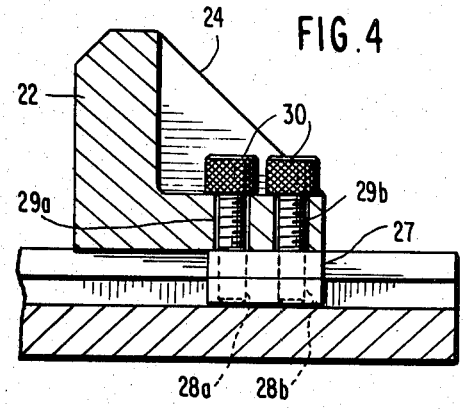
FIG. 4
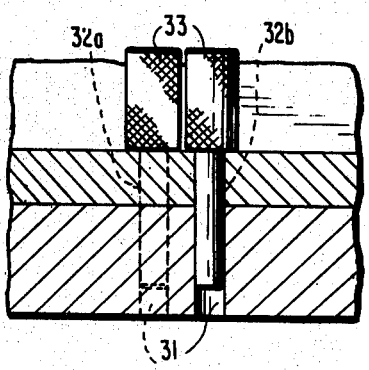
FIG. 7
FIG. 6
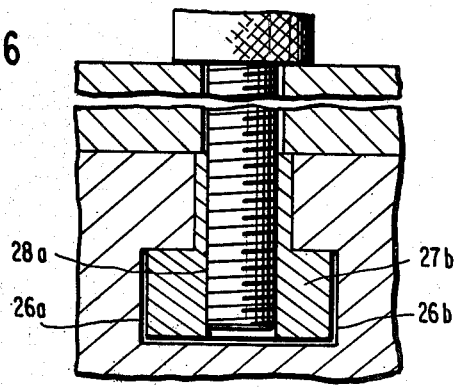

ADJUSTABLE DIE ASSEMBLY

TECHNICAL FIELD

The present invention relates to adjustably positionable die members for use in a press machine assembly capable of bending a workpiece formed of steel plate or the like.

BACKGROUND ART

The present invention generally relates to presses capable of bending plate material or the like. In particular, the present invention is directed to a rugged and dependable adjustable die assembly including a pair of die members capable of being easily, quickly, and accurately positioned relative to one another to allow for selective bending of a workpiece at a variety of predetermined angles and/or radii.

Large capacity hydraulic or mechanical presses, e.g., of about 500 tons and larger capacity, have suffered from long-standing problems preventing quick and accurate adjustment of the die members relative to one another. Because components of the forces generated in such large capacity machine assemblies during the bending of relatively thick steel plate must pass directly through the die members, it has long been considered necessary to employ die members having considerable mass. However, the very mass necessary for withstanding such forces makes it exceedingly difficult to move the die members relative to one another when adjusting the gap between the die members for changing the angle of bend to be formed in the workpiece. Moreover, certain of the temporary fastening or positioning means for the dies which are sufficiently rugged to withstand the aforementioned forces suffer from limitations in respect to versatility and ease of adjustment, while other more versatile and readily adjustable fastening or positioning means suffer from disadvantages of complexity, costliness and inadequate ruggedness.

A known arrangement providing considerable ruggedness and accurate die positioning involves bolting the dies to the inner surfaces of upright sides of an open-top (often open-ended) rigid box or cage. To adjust the die spacing, the dies are unbolted, shims of predetermined thickness are inserted between their back sides and the sides of the box or cage and the dies and sides are then bolted into the box. However, a relatively large number of pairs of shims of various sizes must be employed to provide a wide variety of required bending angles. Because each pair of shims is relatively expensive and must be stored when not in use, this arrangement suffers from disadvantages of cost and storage requirements. More importantly, shims employed in heavy duty press brake assemblies can themselves be exceedingly heavy and cumbersome, often requiring two or more employees just for lifting and positioning the shims. It becomes evident that while shims may vary the gap between die members, shims do not provide a quick, inexpensive, and simple way of adjusting the die members.

In attempts to eliminate the above disadvantages, some presses have been fitted with elaborate carriage mechanisms for moving the die members. However, because such carriage mechanisms are often complex in nature, they are costly and subject to mechanical breakdowns. That they have not fully met existing needs is evidenced by the continuing widespread use of the cumbersome box and shim arrangements described above.

As will become apparent from a reading of the following description and claims, the present invention provides a uniquely constructed adjustable die assembly which overcomes known problems confronting prior art assemblies as discussed hereabove. In particular, the present invention provides a pair of die members capable of being quickly and accurately adjusted relative to the press ram and to one another without the need for any cumbersome shims or costly carriage mechanisms or the like, while resisting force components generated in presses having capacities of up to 500 tons and higher.

DISCLOSURE OF INVENTION

The present invention relates to an improved adjustable die assembly for use in a press of the type having a ram member arranged for up and down movement toward and away from a bed portion of said press. The invention includes a frame portion which may be mounted on or constitutes the bed portion of the press, and a pair of die members supported on an upwardly facing surface of the frame portion. The die members may extend substantially parallel to one another of bending angles or making cylindrical sections, or may be arranged along intersecting lines at one or more angles to one another for bending conical sections. Normally the dies are positioned on opposite sides of the line of travel of the ram, which usually is mounted for reciprocating motion down and up from above the dies. Each die member includes an upward portion extending away from the frame surface and a support portion resting on the frame surface and attached to the upward portion.

In a preferred embodiment, the upward and support portions of each die member have a substantially L-shaped cross-sectional configuration, with the upward portions extending upright and the supporting portions extending away from each other on the frame surface.

Certain aspects of the invention include the use of any effective clamping means for temporarily but fixedly securing the dies to the frame member with or without the aid of certain preferred groove arrangements. In those aspects of the invention which include clamping means, the latter preferably includes one or more grooves (including slots) in the upwardly facing surface of the frame member, which define and are aligned with the path traversed by the dies during their adjustment and which extend at one or more angles to the longitudinal axes of the dies. The grooves may extend along straight or curved lines, depending on whether it is desired to adjust the dies to a variety of parallel or angularly related positions, but in either case, it is preferred that the angle between the aforementioned lines and the longitudinal axes of the dies (viewed perpendicular to the surface on which the dies move during their adjustment) should be more than 45°, e.g., the longitudinal axes of the dies and those portions of the grooves which are nearest such axes (viewed perpendicular to the above-mentioned surfaces) should be more nearly perpendicular than parallel to one another.

Each die extends across at least one such groove. Each die may have its own groove or grooves, or may share a groove or grooves with another die. Preferably, in die sets with longitudinally elongated forming surfaces, in which the present invention provides particular advantages, each die may extend across two or more such grooves at longitudinally distributed positions along the length of the die.

The clamping means also includes support blocks. Each of the aforementioned grooves slidably receives at least one support block having at least one, and preferably a plurality of separate threaded apertures extending upwardly therethrough. Each die member is likewise provided with one or more corresponding apertures extending through it which are alignable with the apertures formed through one of the support blocks. Fasteners such as high tensile strength bolts extend through the apertures in the die members and are selectively threaded into the aligned apertures in the support blocks in order to draw the support blocks into tight clamping engagement with the frame, in a manner to be described in greater detail below, whereby the clamping action between the die members and respective support blocks resists the spreading forces which act on the die members during the pressing operation, thereby inhibiting rocking motion of the die members.

The groove(s) may be any kind of groove (including slots extending all the way through the frame) having parallel or non-parallel sides, but preferably having narrower and wide portions respectively nearer and farther from the upward facing surface of the frame for holding a slidable support block of compatible size and shape captive in the groove. It is preferred that the device includes in the wider portion of the groove (where such is present), or elsewhere in the frame, an under-surface or surfaces, accessible in or through the groove, against which such blocks may be clamped. The groove and support blocks may be of similar or dissimilar but compatible cross-section and size, but are preferably of the same size and shape, and engage one another over a sufficient portion of such under-surface(s) for temporarily but fixedly securing the dies in place in opposition to the spreading forces exerted on the dies during bending of a workpiece. Preferably, the undersurfaces are substantially parallel to the upward surface(s) of the frame on which the dies are supported.

In a particularly preferred embodiment, there is in the frame portion of the device a plurality of separate grooves spaced from and preferably extending substantially parallel to one another, with each of the grooves extending perpendicular to the longitudinal axes of the pair of die members. In said particularly preferred embodiment, each of the grooves has a cross-section of substantially inverted T-shaped configuration, holds captive a pair of support blocks each having a cross-sectional configuration compatible with that of the groove and spans substantially the entire width of the frame surface.

Die sets constructed in accordance with the invention preferably should, but need not necessarily, include positioning means for establishing and maintaining the slidable dies in any one of a predetermined number of positions on the frame member while the dies are in an unclamped condition. Such positioning means, when employed, may take any suitable form but preferably includes arrays of a plurality of positioning apertures, corresponding to said predetermined die positions, extending through the upwardly facing surface(s) of the frame member within the area of said surface traversed by the dies during adjustment thereof. By means of one or more rigistry openings extending through the dies, preferably in the support portions thereof, and alignable with said positioning apertures, and by means of positioning pins adapted for insertion into, and withdrawal from, both said positioning apertures and registry openings, the unclamped dies may be positioned with accuracy and precision in said predetermined positions. Alternately, but less preferably, the arrays of positioning apertures may extend through the lower surfaces of the dies while the registry opening or openings may extend through the frame. The positioning pins, positioning apertures and rigistry openings may all have similar or dissimilar cross-sectional sizes and shapes, provided the size(s) and shape(s) of the pins or individual portions thereof are compatible with the apertures and openings. Preferably the apertures and openings are of the same diameter, and the pins are of substantially the same diameter in order that when the pins are in place the dies will be virtually immobilized against motion toward and away from the plane of movement of the ram. But, it is particularly preferred that the apertures, openings and pins as above described be used in combination with clamping means which are capable of being clamped with sufficient holding power to minimize any tendency for the dies to roll outwardly relative to the ram during workforming.

In certain circumstances, such as, for example, when it is acceptable or convenient to dedicate a press to the kind of bending work normally performed on a press brake, the above-mentioned frame of the die set may itself constitute the bed of the press, and the above-mentioned grooves may then be formed in the press bed. Alternatively, the frame could be welded or otherwise permanently fastened to the press bed.

For purposes of explanation only, the present invention is illustrated in conjunction with a press brake assembly. However, the present invention is not to be limited to use with only a press brake assembly; rather, the present invention is equally adaptable for use with almost any type of machine assembly which employs a reciprocating work member designed for engaging a workpiece mounted on a pair of die members. In addition, the die members are not considered to be limited to use with plate-shaped workpieces; rather, the die members are believed to be of use in supporting workpieces of almost any configuration.

BRIEF DESCRIPTION OF DRAWINGS

A preferred embodiment of the present invention will now be described in greater detail in the following portions of the specification when taken in conjunction with the attached drawings in which like reference characters identify identical apparatus, and in which:

FIG. 3 is a schematic end view of the die members of FIG. 1;

FIG. 4 is a view taken along the section A—A in FIG. 2;

FIG. 5 is a view taken along the section B—B in FIG. 2;

FIG. 6 is a view taken along the section C—C in FIG. 2;

FIG. 7 is a view taken along the section D—D in FIG. 2; and

FIG. 8 is a schematic end view of an alternative embodiment of the present invention.

BEST MODE FOR CARRYING OUT THE INVENTION

Figure 2:
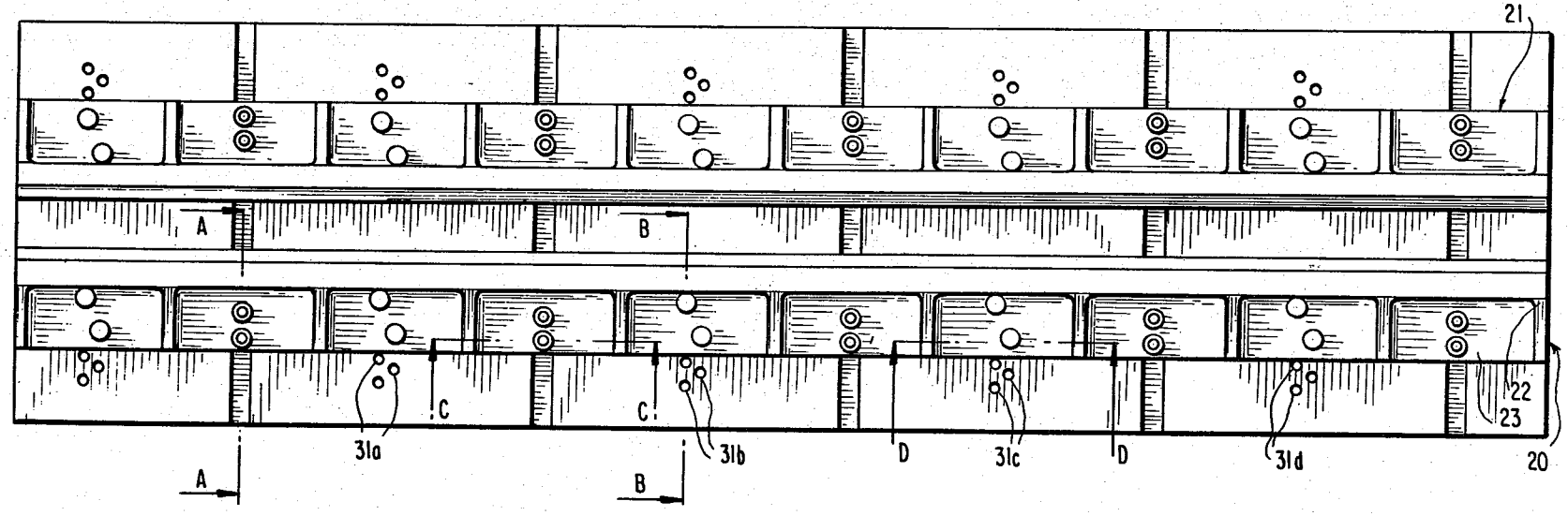
FIG. 2 is a schematic representation of a top view of the embodiment according to FIG. 1.

With reference to FIGS. 1–8, a preferred embodiment of the present invention will now be described in detail. As shown in FIG. 3, a press brake assembly is generally indicated by the numeral 10 and, includes a ram 11 arranged for conventional, reciprocating movement toward and away from a fixed bed 12 of the press brake assembly 10. Because the support structure of the press assembly is itself conventional in nature, it has not been shown for reasons of simplicity. Reciprocating ram 11 may be selectively powered by any conventional power source such as hydraulic, magnetic, or even manual power. A conventional press brake assembly having such reciprocating ram is suggested in U.S. Pat. No. 2,451,302, issued Oct. 12, 1948, to Peters, and incorporated by reference thereto.

Referring again to FIG. 3, the fixed bed 12 supports a frame porton of the present invention which includes a steel plate or platen 13 and a pair of generally gusset-shaped side supports 14*a* and 14*b*. Each of the side supports 14*a* and 14*b* extends between fixed bed 12, and a bottom surface of plate 13. In the preferred embodiment shown in FIG. 3, plate 13 is permanently attached to side supports 14*a* and 14*b* by a conventional fastening such as weldings 16 or the like, with a portion of fixed bed 12 also directly supporting plate 13 along a common contact surface 17.

A pair of adjustable die members 20 and 21 are slidably disposed on a substantially planar surface of plate 13 facing toward reciprocating ram 11. During operation, a workpiece WP of sheet metal or the like is placed across die members 20 and 21 prior to actuation of reciprocating ram 11. Upon actuation of ram 11, a curved male end portion 35 of ram 11 is caused to move from a rest position toward fixed bed 12, with the curved end portion 35 eventually contacting workpiece WP. Further movement of ram 11 results in the bending of workpiece WP as shown in FIG. 3. As the die members 20 and 21 are brought closer together, the angle of bend formed between opposite sides of a workpiece WP increases for any given depth of penetration of the male end portion 35. Likewise, as the die members 20 and 21 are moved further apart from one another, the angle of bend formed between opposite sides of the workpiece WP decreases for any given penetration. By adjusting the spacing between die members 20 and 21 and the depth of penetration of the male end portion 35, it becomes possible to form a variety of different bends in a workpiece WP with a ram employing a single curved end portion and a single pair of die members. As can be well understood, if the shape of curved end portion 35 of ram 11 is changed, bends of additional size can be formed in workpiece WP as needed. Regardless of the particular shape of the curved end portion, accurate positioning of die members 20 and 21 and accurate selecting of penetration depth provide a manner for directly controlling the angle or bend formed in a workpiece WP. As will become clear hereafter, the present invention provides a simple structure for quickly and accurately positioning die members 20 and 21 relative to one another, while at the same time retaining the die members in their proper positions on plate 13 as ram 11 deforms workpiece WP.

Figure 1:
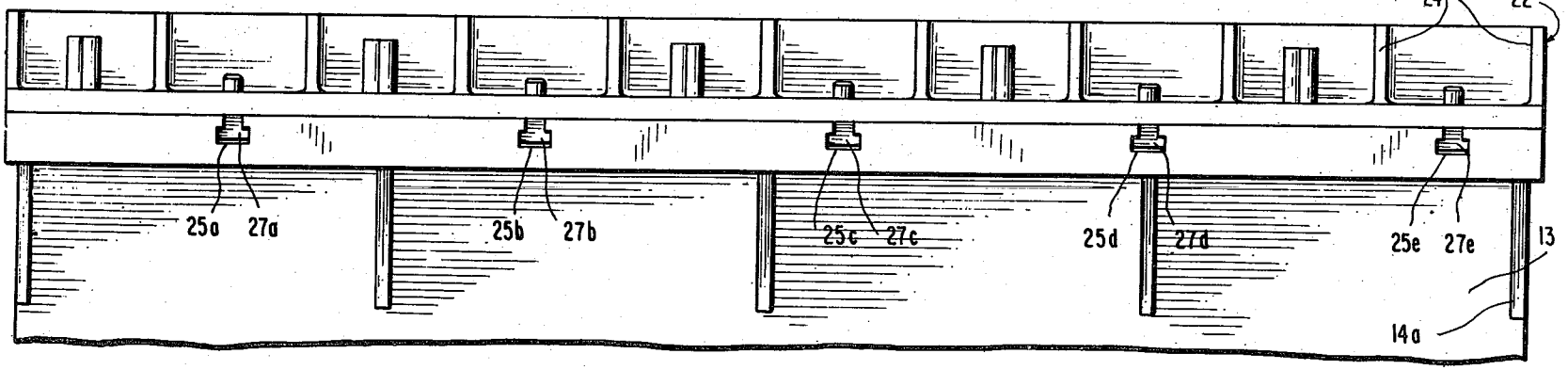
FIG. 1 is a schematic representation of a side view of a press assembly employing die members formed in accordance with a preferred embodiment of the present invention.

Turning now to FIGS. 1 and 2, the unique manner in which the die members are adjustably supported on plate 13 will now be explained in detail. Because the facing die members 20 and 21 are of similar construction, a discussion of one of the die members is believed to be sufficient to provide a proper understanding of both die members. As shown in FIGS. 1 and 2, die member 20 has an elongated configuration including an upright portion 22 and an attached, support portion 23 which rests on plate 13. The upright and support portions form a substantially L-shaped configuration. To provide additional strength to die member 20, a plurality of substantially triangularly shaped gussets 24 extend parallel to one another between portions 22 and 23. Gussets 24 are integrally attached to portions 22 and 23 and provide support for resisting forces transmitted from ram 11 through the workpiece WP and into die members 20 and 21. It is noted in FIG. 3 that the support portions 23 of the die members 20 and 21 extend substantially away from each other as well as away from the projected line of travel of reciprocating ram 11.

A plurality of separate groove assemblies 25*a–e* are each formed across plate 13 in a direction extending substantially transversely to the longitudinal axis of plate 13 and die members 20 and 21, respectively. In a preferred embodiment, the grooves 25*a–e* extend substantially parallel to one another across the entire width of plate 13. The number of grooves 25*a–e* shown in FIGS. 1 and 2 is in no way considered to limit the number of grooves actually employed, but has been illustrated for purposes of explanation only. The actual number of grooves is entirely dependent on a number of factors such as the size of plate 13, the size of die members 20 and 21 and the capacity of the press brake assembly. Furthermore, as best shown in FIGS. 1 and 6, each groove 25 is formed with a pair of undercut portions 26*a* and 26*b* which extend transversely into portions of plate 13 spaced from the surface of plate 13 contacting die members 20 and 21, thereby forming a substantially inverted T-shaped configuration. Each groove 25*a–e* serves as a track for maintaining the proper longitudinal positioning of the die members relative to one another as well as maintaining the proper longitudinal positioning of the die members in contact with plate 13 as will be explained. While each groove 25*a–e* is shown to extend completely across plate 13, it is considered within the scope of the present invention to have some or all of the grooves 25*a–e* extend only part way across plate 13. It is also not necessary that grooves 25*a–e* extend from opposite sides into alignment with one another, rather, it is only necessary that a plurality of grooves extend from opposite sides of plate 13 toward the line of travel of ram 11 in order to allow die members 20 and 21 to move toward and away from one another.

As shown in FIG. 6, a support block 27*b* is slidably mounted within a groove 25*b*, with block 27*b* having an inverted T configuration substantially similar to the inverted configuration of groove 25*b*. In a similar manner, each of the grooves 25*a–e* also receives and supports a separate block 27*a–e*. In a preferred embodiment, each block 27*a–e* has an inverted T configuration similar in shape to the configuration of a respective groove 25*a–e*. Each block 27*a–e* is relatively short, having a length substantially similar to the length of the portion of gusset 24 contacting portion 23 of the die members, as best shown in FIG. 4.

It is further noted that each block 27*a–e* has an end surface extending substantially flush with an adjacent end surface of either member 20 or 21. Each support block 27*a–e* is formed with at least one, and preferably two threaded apertures 28*a* and 28*b* extending away from die members 20 and 21. In a like manner, each die member 20 and 21 includes a plurality of pairs of apertures 29*a* and 29*b* which are positioned such that when aperture 29*a* is aligned with block aperture 28*a*, aperture 29*b* will be aligned with block aperture 28*b*. During assembly, each of the blocks 27*a–e* is inserted in a separate groove 25*a–e* and is positioned such that apertures 28*a* and 28*b* are aligned with respective apertures 29*a* and 29*b*. A plurality of high tensile strength, threaded fastening bolts 30 are then inserted through apertures 29*a* and 29*b*, with end portions of the bolts 30 projecting into respectively aligned apertures 28*a* and 28*b*.

As the bolts 30 are rotated in the appropriate direction, the threads formed on bolts 30 engage the threads formed in apertures 28*a* and 28*b* and draw the bolts 30 further into the blocks 27*a–e*. When further rotation of bolts 30 is attempted, the blocks 27*a–e* are drawn toward die members 20 and 21, until portions of each block 27*a–e* engage the transverse portions 26*a* and 26*b* of a respective groove 25*a–e*, preventing further movement of the block. At this time, the block 27 and the adjacent portion of the die member 20 are clamped into tight contact with plate 13 via bolts 30. The tight contact between blocks 27*a–e* and plate 13 resist sliding movement of the blocks within the grooves 25. More importantly, the interaction between blocks 27 and the transverse portions 26*a* and 26*b* of grooves 25 prevents the attached die members from being lifted away from plate 13, even when subjected to lifting or rocking forces transmitted from ram 11 through workpiece WP.

In order to properly align the die members 20 and 21 relative to one another, a plurality of pairs of positioning apertures 32*a* and 32*b* are formed through alternating portions 23 defined by adjacent gussets 24. Each pair of positioning apertures is of identical configuration and is spaced an equal distance from an edge of each die member. In particular, each pair of positioning apertures 32*a* and 32*b* is preferably staggered with respect to gussets 24 located on opposite sides thereof. Furthermore, each pair of apertures 32*a* and 32*b* extends completely through portion 23 for a purpose which will become clear.

As shown in FIG. 2, a plate 13 is formed with a plurality of spaced groups of apertures 31*a–e* with the groups of apertures having similar configurations and being equally spaced from the same edge of plate 13 as the positioning apertures 32*a* and 32*b*. Furthermore, each group of apertures 31*a–e* includes a plurality of apertures staggered relative to grooves 25 located on either side. The groups of apertures 31*a–e* are arranged so as to align with the positioning apertures 32*a* and 32*b* when the die member is uniformly spaced from the edge of plate 13. Because each die member includes positioning apertures 32*a* and 32*b* which are alignable with apertures in the various groups of apertures 31*a–e*, it becomes possible to quickly and easily align the positions of the die members 20 and 21 by merely aligning each pair of apertures 32*a* and 32*b* with corresponding apertures in the groups of apertures 31*a–e*. Because the groups of apertures 31*a–e* and the positioning apertures 32*a* and 32*b* are each staggered, it becomes possible to move die members 20 and 21 relatively small distances toward and away from one another and still align corresponding openings with one another.

A separate positioning pin 33 is inserted through each of the openings 32*a* and 32*b*, with a portion of the pin 33 entering one of the openings 31*a–e*. Pins 33 prevent the die members 20 and 21 from sliding out of their properly aligned positions even when ram 11 deforms workpiece WP. Because the forces generated during the actual bending operation are substantially absorbed by the blocks 27*a–e* and pins 33, the more expensive bolts 30 are not directly subject to the shear forces sufficient for causing premature failure of such bolts. In addition, pins 33 serve to ensure quick, and yet precise alignment of the die members 20 and 21 relative to one another. As shown in FIG. 5, each of the locating pins 33 has an enlarged end portion 34 which is knurled to allow for easy insertion and removal from the aligned apertures. While the particular arrangement of positioning apertures 32*a* and 32*b* and groups of apertures 31*a–e* shown in FIG. 2 is preferred, it is considered within the scope of the present invention to employ various configurations of the groups of apertures 31*a–e* as well as corresponding configurations of the positioning apertures 32*a* and 32*b* so as to provide alignment therebetween when the die members are uniformly spaced from one another.

The present invention is not to be limited to the embodiment disclosed hereabove, rather, the scope of protection for the present invention is only to be limited by the claims following hereafter.

What is claimed is:

1. An assembly for precisely positioning a pair of die members on the bed of a press beneath a ram mounted for movement toward and away from the bed, said assembly comprising:

a frame member having an upwardly facing surface contacting the pair of die members;

clamping means extending between each of the die members and said frame member for selectively clamping and unclamping each of the die members against said frame member; and positioning means, independently operable of said clamping means, extending between the die members and preselected locations on said upwardly facing surface of said frame member for accurately positioning the die members relative to one another on said frame member.

2. An assembly according to claim 1, wherein said clamping means comprises groove means extending through said upwardly facing surface of said frame member and disposed more nearly perpendicular than parallel to longitudinal axes of the die members, said groove means including at least one under-surface portion spaced from and extending substantially parallel to said upwardly facing surface of said frame member.

3. An assembly according to claim 2, wherein said clamping means further comprises a plurality of separate support blocks slidably received in said groove means, said support blocks each having a surface portion of cross-section and size for engaging a sufficient portion of said groove under surface so as to prevent withdrawal of said support blocks from said groove means in the direction of said upwardly facing surface.

4. An assembly according to claim 3, wherein said groove means comprises a plurality of separate grooves extending substantially parallel to and spaced from one another, each groove having at least one end portion extending through one of two opposed side walls of said frame member and each groove having a substantially inverted T cross-sectional configuration.

5. An assembly according to claim 4 wherein at least one support block is positioned in each of said separate grooves, with each support block having a substantially inverted T cross-sectional configuration substantially similar in size to a surrounding groove.

6. An assembly according to claim 5 wherein said clamping means further comprises a pair of threaded apertures extending through each of said support blocks alignable with corresponding openings extending through either of the die members, and a separate threaded bolt extending through each of each pair of aligned openings for drawing said support block and die member into clamping engagement with said frame member.

7. An assembly according to claim 1, wherein said positioning means comprises:

an array of positioning apertures each extending through the upward surface of said frame member at predetermined positions corresponding to various desired die positions;

at least one registry opening extending through each of said die members and alignable with said positioning apertures; and positioning pin means insertable through and withdrawable from said positioning apertures and registry openings for accurately positioning the die members relative to one another on said frame member.

8. An assembly according to claim 7 wherein each registry opening and each positioning aperture has a substantially cylindrical cross-sectional configuration.

9. An assembly according to claim 7 wherein said positioning pin means comprises a plurality of separate, substantially cylindrically-shaped pin members each having a cross-sectional configuration compatible with both said positioning apertures and registry openings to allow for insertion of said pin member through said openings when aligned with one another.

10. An assembly according to claim 7 wherein a plurality of pairs of registry openings extend through each die member, with said pairs of registry openings being spaced from one another in a direction parallel to the longitudinal axis of each die member, respectively, and each pair of registry openings forms a separate imaginary line extending substantially perpendicular to the longitudinal axis of the die member through which said registry openings extend.

11. An assembly according to claim 7 wherein said array of positioning apertures comprises separate groups of apertures spaced from one another across the upwardly facing surface of said frame member, each of said groups of apertures forming a strip extending in a direction substantially perpendicular to the longitudinal axis of each of the die members, respectively.

12. An assembly according to claim 1 wherein said frame member forms an integral upper portion of the bed.

13. An assembly according to claim 1 wherein said frame member is separate from and physically attached to the bed.

* * * * *